US007218060B1

(12) United States Patent
Lin et al.

(10) Patent No.: US 7,218,060 B1
(45) Date of Patent: May 15, 2007

(54) FLYBACK BALLAST FOR FLUORESCENT LAMP

(75) Inventors: Jea-Sen Lin, Danshuei Township, Taipei County (TW); Ta-yung Yang, Milpitas, CA (US)

(73) Assignee: System General Corp., Taipei Hsien (TW)

( * ) Notice: Subject to any disclaimer, the term of this patent is extended or adjusted under 35 U.S.C. 154(b) by 0 days.

(21) Appl. No.: 11/370,280

(22) Filed: Mar. 7, 2006

(51) Int. Cl.
*H05B 37/02* (2006.01)

(52) U.S. Cl. ..... 315/219; 315/291; 315/362

(58) Field of Classification Search ..... 315/200 R, 315/209 R, 219, 209 CD, 291, 362; 363/21.12
See application file for complete search history.

(56) References Cited

U.S. PATENT DOCUMENTS 4,562,522 A * 12/1985 Adams et al. ..... 96/23
4,814,963 A * 3/1989 Petersen ..... 363/20
4,814,965 A * 3/1989 Petersen ..... 363/65
4,937,726 A * 6/1990 Reustle ..... 363/21.12
4,972,292 A * 11/1990 Petersen ..... 361/56
4,980,811 A * 12/1990 Suzuji et al. ..... 363/21.07
5,619,404 A * 4/1997 Zak ..... 363/21.09
6,366,030 B1 * 4/2002 Ito et al. ..... 315/291
6,714,425 B2 * 3/2004 Yamada et al. ..... 363/21.12
6,819,059 B2 * 11/2004 Block et al. ..... 315/241 S
7,061,779 B2 * 6/2006 Yang ..... 363/21.04

* cited by examiner

*Primary Examiner*—Thuy Vinh Tran
(74) *Attorney, Agent, or Firm*—J.C. Patents

(57) ABSTRACT

A flyback ballast for fluorescent lamps is provided. A transformer is utilized to control the power delivered to the lamp. A first switch is coupled to the first winding of the transformer. A first filter is coupled to a second filter through a first terminal pair of a lamp. The second switch is coupled to the third switch through a second terminal pair of the lamp. A switching signal is provided to the first switch to control the power of the transformer delivered to the filters. A second switching signal and a third switching signal are provided to the second switch and the third switch respectively to control the power delivered to the lamp. No glow discharge is occurred during the preheating interval.

10 Claims, 3 Drawing Sheets

FLYBACK BALLAST FOR FLUORESCENT LAMP

BACKGROUND OF THE INVENTION

1. Field of Invention

The present invention is related in general to a ballast, and more particularly, to a ballast of fluorescent lamps.

2. Description of Related Art

Fluorescent lamps are the most popular light source on the market today. By improving the efficiency of the fluorescent lamps and/or providing the dimming control will offer significant savings in energy. Therefore, in recent developments, the capability for improving the efficiency and power savings for fluorescent lamps is a major concern. In addition, prolonging the fluorescent lamp's lifespan is also important for reducing environmental pollution. The proper starting and operating of the lamp is able to provide a longer lamp lifespan. Prior to ignition, the cathode filaments of the lamp electrodes should be preheated to an appropriate emission temperature. During normal operation, the cathode filaments should be maintained at an emission temperature. Furthermore, the glow discharge should be prevented because it will cause the filaments to wear out. The glow discharge is occurred when the filaments are being preheated and during an instance of higher voltage across the lamp. Therefore, the lamp voltage should be limited to within controlled ranges during the preheating interval. In order to completely eliminate the glow discharge, an additional filament heating circuit may be needed. However, such an approach has led to higher costs.

FIG. 1 shows a conventional electronic ballast with a series resonant inverter. The half-bridge inverter includes two switches 10 and 11. The two switches 10 and 11 are interchangeably switched on and off under a 50% duty cycle at the desired switching frequency, which can be controlled to fulfill the requirements during both starting and normal operations. The resonant circuit is formed by an inductor 13, a capacitor 14 and a fluorescent lamp 15. The fluorescent lamp 15 is coupled in parallel with a capacitor 16. The capacitor 14 is operated as the starting circuit. During the preheating stage, the lamp voltage can be maintained low by deliberately operating the ballast at the resonance frequency of the starting circuit. After the cathode filaments have been preheated to an appropriate emission temperature, the ballast frequency is adjusted to generate the required high ignition voltage. Once the lamp is running, the frequency is controlled to produce the required lamp voltage. The drawback of the aforementioned circuit is the having of a high glow current. During the preheating interval, the lamp voltage is determined by the switching frequency of the switches 10, 11 and the resonant frequency of the starting circuit. Once the ballast has been switched on, a resonant current is flowed through the capacitor 16 and the filaments for preheating. At this time, the lamp voltage is simultaneously produced on the lamp, which causes an inevitable glow discharge. Another disadvantage of the aformentioned circuit is the reduced control of efficiency during normal operation. The resonant frequency is varied according with a change of the parasitic devices of the fluorescent lamp. The parasitic devices of the fluorescent lamp, such as equivalent capacitance, for example, are changed in response to a change in temperature and the age of the lamp. Furthermore, the input voltage, the resonant frequency, and the characteristics of the fluorescent lamp affect the power consumption of the lamp.

The objective of the present invention is to provide a flyback ballast with improved efficiency. Another objective of the present invention is to eliminate the glow current, and thus prolonging the lamp lifespan.

SUMMARY OF THE INVENTION

The present invention provides a flyback ballast for fluorescent lamps. A transformer is utilized to control the power delivered to a lamp. A first switch is coupled to a first winding of the transformer. A first filter and a second filter are coupled to a second winding and a third winding of the transformer, respectively. The first filter is coupled to the second filter through a plurality of first terminals of a lamp. The second switch is coupled to the third switch through a plurality of second terminals of the lamp. A switching signal is provided to the first switch to control the power of the transformer delivered to the first filter and the second filter. A second switching signal and a third switching signal are provided to the second switch and the third switch respectively to control the power delivered to the lamp. A first range of power is delivered to the first filter and the second filter during the preheating interval. Meanwhile, the second switch is turned on and the third switch is to perform on/off switching for preheating the lamp. No glow discharge is occurred during the preheating interval, which results in the extension of lamp life. A second range of power is delivered to the first filter and the second filter under normal operation, in which the second range of the power is higher than the first range. The flyback power mode operation is to provide dimming control with higher efficiency for the lamps.

BRIEF DESCRIPTION OF ACCOMPANIED DRAWINGS

The accompanying drawings are included to provide a further understanding of the present invention, and are incorporated in and constitute a part of this specification. The drawings illustrate embodiments of the present invention and, together with the description, serve to explain the principles of the present invention. In the drawings, FIG. 1 shows a conventional electronic ballast with a series resonant inverter.

DESCRIPTION OF THE EMBODIMENTS

Figure 1:
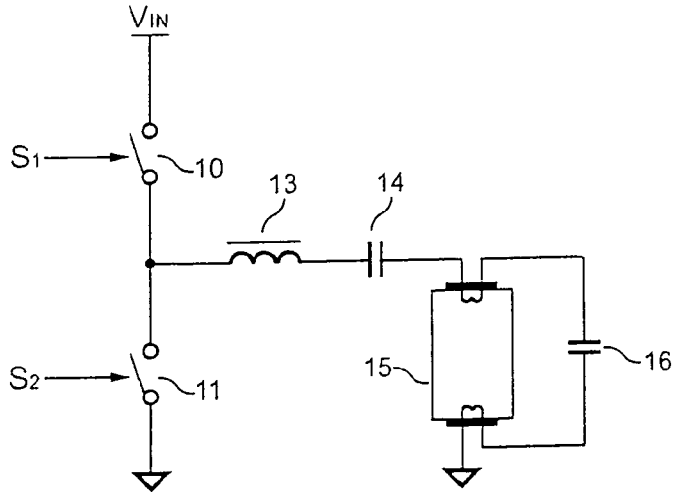
FIG. 1 (Prior Art)
Figure 2:
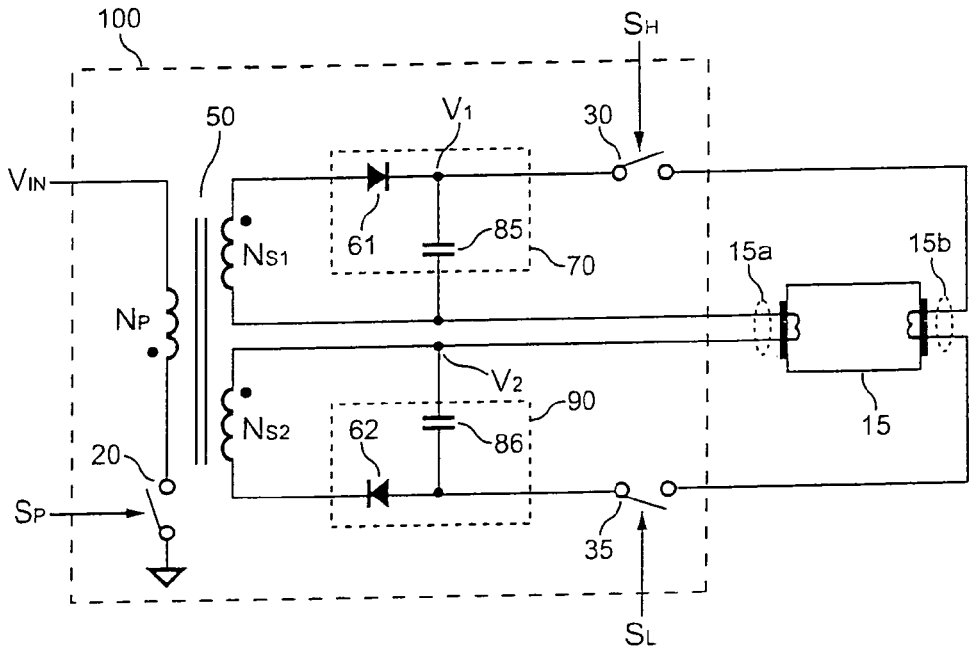
FIG. 2 is a circuit schematic of a flyback ballast according to an embodiment of the present invention.

FIG. 2 shows the circuit schematic of a flyback ballast 100 for a fluorescent lamp 15 according to an embodiment of the present invention. The flyback ballast includes a transformer 50 having a first winding $N_P$, a second winding $N_{S1}$, and a third winding $N_{S2}$. A switch 20 is coupled to the first winding $N_P$ of the transformer 50 to form a flyback converter. A plurality of rectifiers 61 and 62 are coupled to the second winding $N_{S1}$ and the third winding $N_{S2}$, respectively. A capacitor 85 is coupled to the rectifier 61 to form a first filter 70. A capacitor 86 is coupled to the rectifier 62 to form a second filter 90. A switch 30 is coupled to the first filter 70.

A switch 35 is coupled to the second filter 90. The first filter 70 is coupled to the second filter 90 through a first terminal pair 15*a* of a lamp 15. The switch 30 is coupled to the switch 35 through a second terminal pair 15*b* of the lamp 15. A switching signal $S_P$ is provided to the switch 20 to control the power of the transformer 50 delivered to the first filter 70 and the second filter 90. When the input voltage $V_{IN}$ is applied to the first winding $N_P$, the energy $\epsilon_P$ will be stored inside the transformer 50. It is given by the following equations:

$$\epsilon_P = \tfrac{1}{2} \times L_P \times I_P^2 \tag{1}$$

$$I_P = \frac{V_{IN}}{L_P} \times T_{ON} \tag{2}$$

In accordance with the equations (1) and (2), the power P transferred through the transformer 50 can be expressed as the following:

$$P = \frac{V_{IN}^2 \times T_{ON}^2}{2 \times L_P \times T} \tag{3}$$

in which $L_P$ is the inductance of the first winding $N_P$, $I_P$ is the switching current of the first winding $N_P$ when the switch 20 is turned on, $T_{ON}$ is the on time of the switch 20, and T is the switching period.

The energy is stored into the transformer 50 when the switch 20 is turned on. The energy is discharged to the second winding $N_{S1}$ and the third winding $N_{S2}$ once the switch 20 is turned off. By controlling the on time $T_{ON}$ of the switching signal $S_P$, the power transferred to the first filter 70 and the second filter 90 is regulated. A switching signal $S_H$ and a switching signal $S_L$ are provided to the switch 30 and the switch 35 respectively for controlling the power delivered to the lamp 15.

Figure 3:
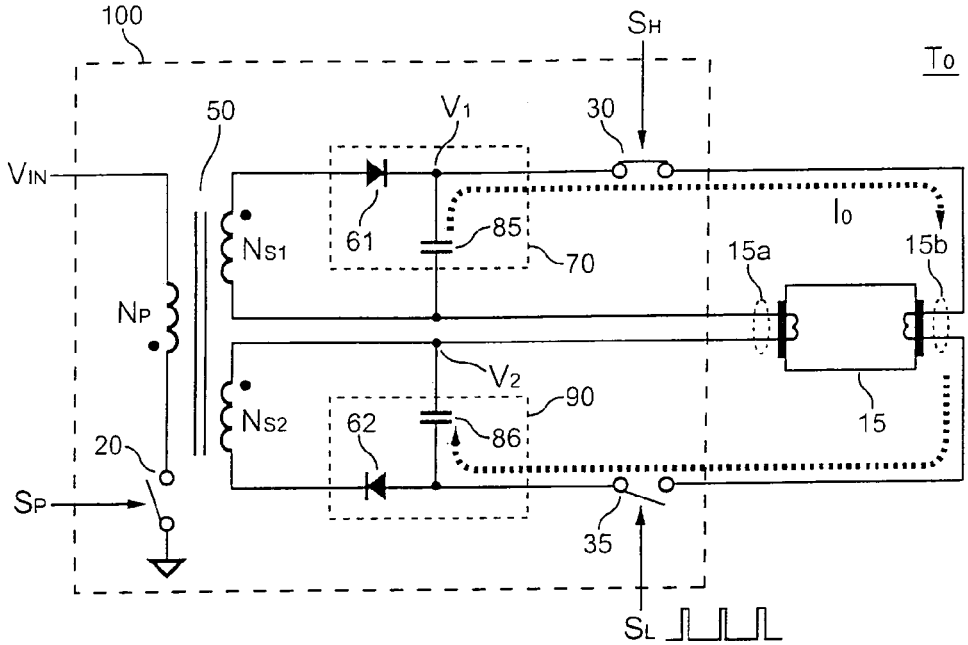
FIG. 3 shows the flyback ballast according to an embodiment of the present invention during a preheating interval.

FIG. 3 shows the operation of the flyback ballast according to an embodiment of the present invention during a preheating interval. The flyback converter delivers a first range of the power to the first filter 70 and the second filter 90 during the preheating interval. Meanwhile, while the switch 30 is turned on, the switch 35 is used to perform on/off switching to preheat the lamp 15. No glow discharge is occurred during the preheating interval, which extends the lamp life.

Figure 4:
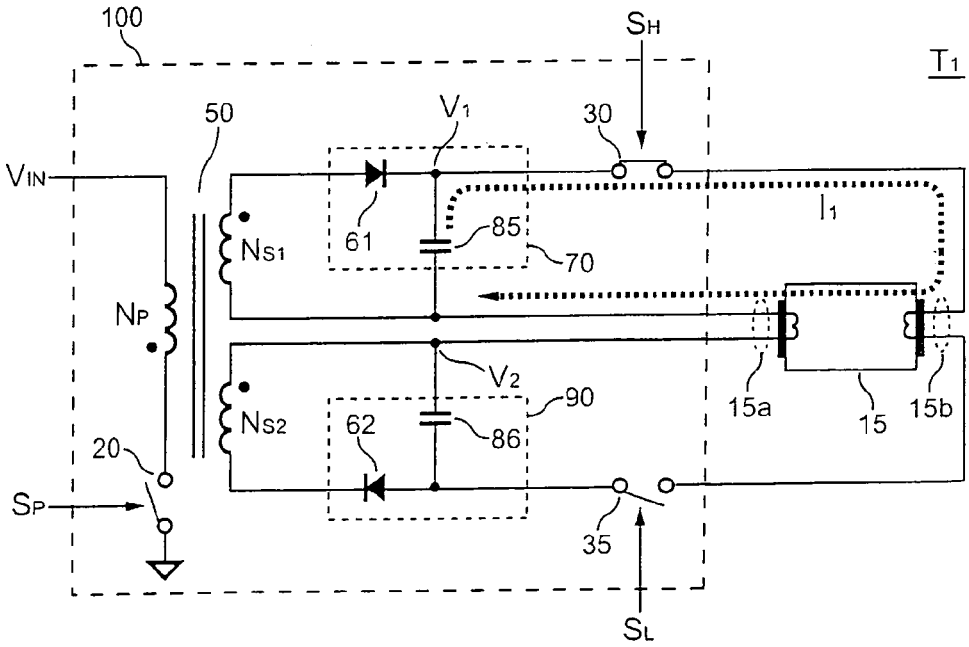
FIG. 4 shows a first phase of the flyback ballast during a normal operation.
Figure 5:
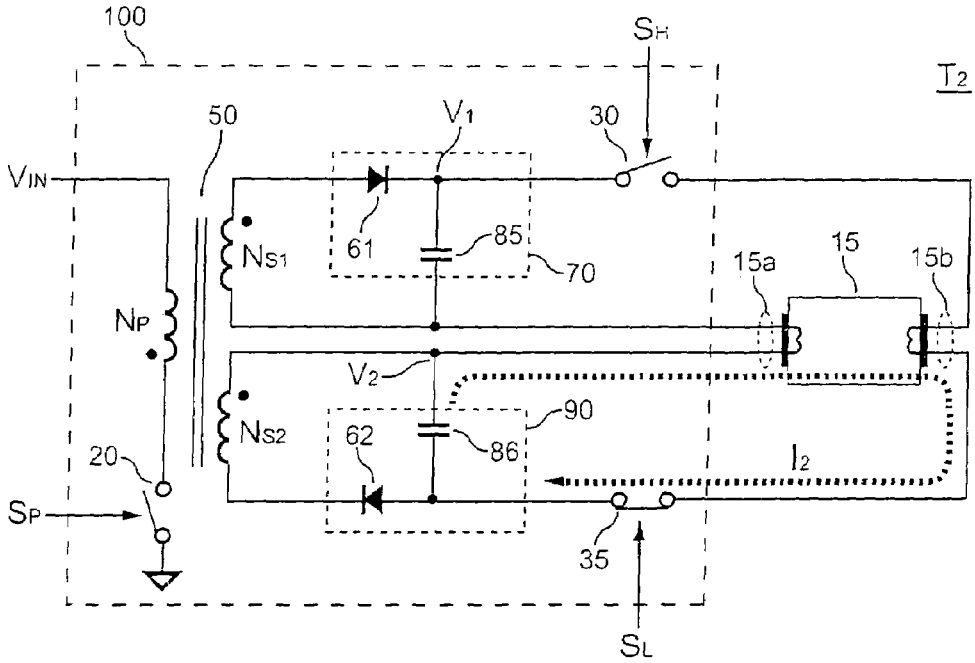
FIG. 5 shows a second phase of the flyback ballast during the normal operation.
Figure 6:
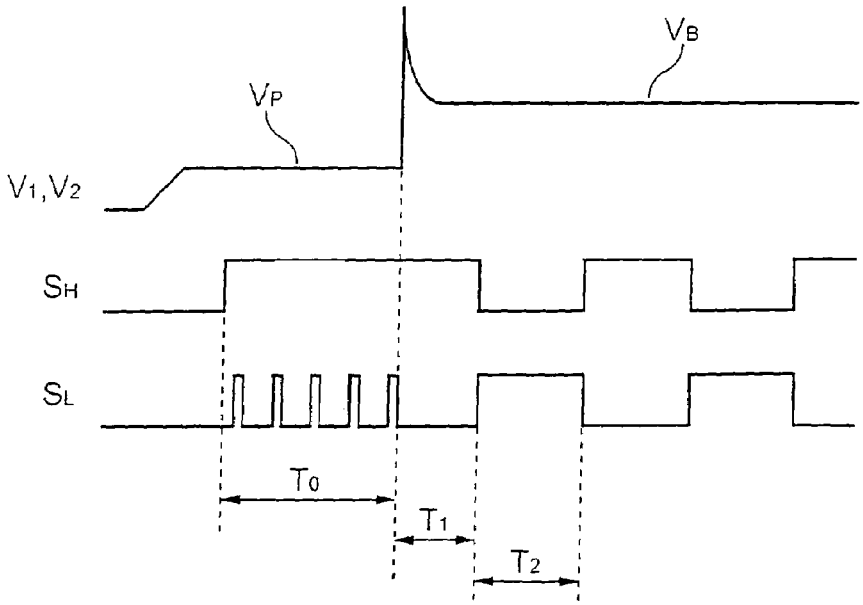
FIG. 6 shows a plurality of waveforms of the flyback ballast according to an embodiment of the present invention.

Under normal operation, the flyback converter delivers a second range of power to the first filter 70 and the second filter 90. The second range of the power is higher than the first range. FIG. 4 and FIG. 5 show the first phase and the second phase of the operation of the flyback ballast, in which the switch 30 and the switch 35 are interchangeably switched on to transfer the power to the lamp 15. The level of the second range of the power determines the brightness of the lamp 15. FIG. 6 shows a plurality of waveforms of the flyback ballast 100 according to an embodiment of the present invention. During a preheating interval $T_0$, the first range of the power generates a voltage $V_P$ at the first filter 70 and the second filter 90. After the preheating, the switch 35 is turned off. A second range of the power is applied to the first filter 70 and the second filter 90. A higher lamp voltage will be generated to ignite the lamp 15. After the ignition, a voltage $V_B$ will be produced at the first filter 70 and the second filter 90, and the switch 30 and the switch 35 are interchangeably switched on ($T_1$ and $T_2$) to transfer the power to the lamp 15. Since the flyback converter can accurately control the output power, high efficiency dimming control for the lamps is realized.

While the present invention has been particularly shown and described with reference to preferred embodiments thereof, it will be understood by those of ordinary skill in the art that various changes in form and details may be made therein without departing from the spirit and scope of the present invention as defined by the appended claims.

What is claimed is:

1. A flyback ballast, comprising:

a transformer, having a first winding, a second winding, and a third winding;

a first switch coupled to the first winding of the transformer to form a flyback converter;

a first rectifier and a second rectifier coupled to the second winding and the third winding, respectively;

a first capacitor coupled to the first rectifier to form a first filter;

a second capacitor coupled to the second rectifier to form a second filter;

a second switch coupled to the first filter;

a third switch coupled to the second filter; and wherein the first filter is coupled to the second filter through a first terminal pair of a lamp, the second switch is coupled to the third switch through a second terminal pair of the lamp, a switching signal is provided to the first switch to control the power of the transformer delivered to the first filter and the second filter, and a second switching signal and a third switching signal are provided to the second switch and the third switch respectively for controlling the power delivered to the lamp.

2. The flyback ballast as claimed in claim 1, wherein the energy is stored into the transformer when the first switch is turned on, and the energy is discharged to the second winding and the third winding once the first switch is turned off.

3. The flyback ballast as claimed in claim 1, wherein the flyback converter delivers a first range of the power to the first filter and the second filter during the preheating interval, in which the second switch is on and the third switch is to perform on/off switching to preheat the lamp.

4. The flyback ballast as claimed in claim 1, wherein the flyback converter delivers a second range of the power to the first filter and the second filter under the normal operation, in which the second range of the power is higher than the first range of the power.

5. The flyback ballast as claimed in claim 1, wherein the second switch and the third switch are interchangeably switched on during normal operation.

6. A ballast, comprising:

a transformer having a first winding, a second winding, and a third winding;

a first switch coupled to the first winding of the transformer;

a first filter and a second filter coupled to the second winding and the third winding, respectively;

a second switch coupled to the first filter;

a third switch coupled to the second filter; and wherein the first filter is coupled to the second filter through a first terminal pair of a lamp, the second switch is coupled to the third switch through a second terminal pair of the lamp, a switching signal is provided to the first switch to control the power of the transformer delivered to the first filter and the second filter, a second switching signal and a third switching signal are provided to the second switch and the third switch respectively to control the power delivered to the lamp.

7. The ballast as claimed in claim 6, wherein the energy is stored into the transformer when the first switch is turned on, and the energy is discharged to the second winding and the third winding once the first switch is turned off.

8. The ballast as claimed in claim 6, wherein a first range of power is delivered to the first filter and the second filter during the preheating interval, in which the second switch is turned on and the third switch is to perform on/off switching to preheat the lamp.

9. The ballast as claimed in claim 6, wherein a second range of power is delivered to the first filter and the second filter for the normal operation, in which the second range of the power is higher than the first range.

10. The ballast as claimed in claim 6, wherein the second switch and the third switch are interchangeably switched on for the normal operation.

* * * * *